US007089968B2

(12) United States Patent
Aldrich

(10) Patent No.: US 7,089,968 B2
(45) Date of Patent: Aug. 15, 2006

(54) SEAMED FELTS

(75) Inventor: William D. Aldrich, Wilson, NC (US)

(73) Assignee: Voith Fabrics GmbH & Co., Heidenheim (DE)

( * ) Notice: Subject to any disclaimer, the term of this patent is extended or adjusted under 35 U.S.C. 154(b) by 111 days.

(21) Appl. No.: 10/837,005

(22) Filed: Apr. 30, 2004

(65) Prior Publication Data

US 2004/0216798 A1 Nov. 4, 2004

Related U.S. Application Data

(60) Provisional application No. 60/466,695, filed on Apr. 30, 2003.

(51) Int. Cl.
*D21F 7/08* (2006.01)

(52) U.S. Cl. ..... 139/383 A; 139/383 AA; 162/358.2; 162/900

(58) Field of Classification Search ..... 139/383 A, 139/383 AA; 162/358.2, 900, 904; 428/193; 442/270

See application file for complete search history.

(56) References Cited

U.S. PATENT DOCUMENTS 4,863,786 A * 9/1989 Green et al. ..... 442/241
4,883,096 A * 11/1989 Penven ..... 139/383 A
4,979,543 A * 12/1990 Moriarty et al. ..... 139/383 AA
5,476,123 A 12/1995 Rydin
5,525,410 A * 6/1996 Hansen ..... 442/197
5,657,797 A * 8/1997 Townley et al. ..... 139/383 AA
5,732,749 A * 3/1998 Fargeout ..... 139/383 AA
5,787,936 A * 8/1998 Snipes ..... 139/383 AA
5,799,709 A 9/1998 Shipley
5,875,822 A * 3/1999 Fargeout ..... 139/383 AA
5,913,339 A 6/1999 Lee
5,945,357 A * 8/1999 Quigley ..... 442/189
6,213,164 B1 * 4/2001 Ostermayer et al. .. 139/383 AA
6,267,150 B1 7/2001 Herring
6,273,146 B1 8/2001 Herring
6,273,147 B1 8/2001 Herring
6,289,940 B1 9/2001 Herring
6,302,155 B1 * 10/2001 Rydin ..... 139/383 AA
6,318,413 B1 * 11/2001 Herring ..... 139/383 AA
6,349,749 B1 2/2002 Quigley
6,479,414 B1 * 11/2002 Hauer ..... 442/326
6,508,278 B1 * 1/2003 Kornett ..... 139/383 A
6,719,014 B1 * 4/2004 Kornett ..... 139/383 R
6,902,652 B1 * 6/2005 Martin ..... 162/348

FOREIGN PATENT DOCUMENTS

EP 1 233 103 A1 2/2002

* cited by examiner

*Primary Examiner*—John J. Calvert
*Assistant Examiner*—Robert H Muromoto
(74) *Attorney, Agent, or Firm*—Quarles & Brady Steich Lang LLP

(57) ABSTRACT

Paper making machine fabric comprising weft yarns extending in the machine direction (MD) and forming seaming loops at each end of the fabric, cross machine direction (CD) warp yarns being interwoven with the weft yarns, wherein that at least one multifilament warp yarn is inserted so that there is at least one standard warp yarn between the multifilament yarn and the seaming loops on each side of the seam.

22 Claims, 2 Drawing Sheets

SEAMED FELTS

RELATED APPLICATIONS

This application is based on U.S. Provisional Application No. 60/466,695, filed on Apr. 30, 2003, entitled "Seamed Felts."

FIELD OF THE INVENTION

This Invention relates to improvement in seamed felts for use in the press section of a papermaking machine.

BACKGROUND OF THE INVENTION

Paper is conventionally manufactured by conveying a paper furnish, usually consisting of an initial slurry of cellulosic fibres, on a forming fabric or between two forming fabrics in a forming section, the nascent sheet then being passed through a pressing section and ultimately through a drying section of a papermaking machine. In the case of standard tissue paper machines, the paper web is transferred from the press fabric to a Yankee dryer cylinder then creped.

Paper machine clothing is essentially employed to carry the paper web through these various stages of the papermaking machine. In the forming section, the fibrous furnish is wet-laid onto a moving forming wire and water is encouraged to drain from it by means of suction boxes and foils. The paper web is then transferred to a press fabric that conveys it through the pressing section, where it usually passes through a series of pressure nips formed by rotating cylindrical press rolls. Water is squeezed from the paper web and into the press fabric as the web and fabric pass through the nip together. Press fabrics generally comprise a batt of fibres needled to a base fabric. In the final stage, the paper web is transferred either to a Yankee dryer, in the case of tissue paper manufacture, or to a set of dryer cylinders upon which, aided by the clamping action of the dryer fabric, the majority of the remaining water is evaporated.

The base fabrics of press felts are woven endless, whether they are seamed or not, such that the yarns of the weft in the loom lie in the machine direction of the fabric on the paper machine. The weft yarns weave back and forth continuously between the laterally extending edges of the fabric and form a seam loop at the reversals on one side. The two ends formed are then joined together on the machine by means of a pintle wire.

Press felts consist of multiple layers which are secured together by needling. This works by mechanically locking the constituent batt fibres into various layers and in so doing holds them together. In addition, the batt fibre gives a homogenous paper support surface. Due to the method of base fabric manufacture, the area around the seam is free of cross machine direction. (CD) yarns. This means that the ability of the batt fibre to become anchored in this region is much reduced, and the anchoring achieved much less effective than in the main area of the felt. Also, due to the greater void volume in the seam area, in comparison to the main body of the fabric, the propensity to marking of the paper sheet is greatly increased. In order to alleviate this problem a number of methods have been suggested in the prior art.

For example, in U.S. Pat. No. 5,476,123 (RYDIN), it is proposed to interweave an additional CD yarn between the pintle and the ends of the loops which is interlaced only with the upper passes of the loops. EP-A-1,233,103 (ALBANY) similarly discloses the provision of additional CD yarns woven in a leno weave with either the top or bottom layer of the seaming loops.

U.S. Pat. No. 5,799,709 (SHIPLEY) proposes the provision of an additional CD yarn between the last yarn of the main warp system and the pintle, which features relatively long floats over the top MD yarns, and interlacings with the lower MD yarns.

The Herring U.S. Pat. Nos. 6,267,150 and 6,273,146, similarly feature pairs of additional CD yarns inserted between the last standard warp yarn and seam loop with long floats over the top MD yarns, with alternatively spaced interlacings with the lower MD yarns. U.S. Pat. No. 6,289,940 (HERRING) and U.S. Pat. No. 6,318,413 (HERRING) feature additional CD yarns having more interlacings with the top layer than the lower layer, and also non interlaced portions within the loops. U.S. Pat. No. 6,273,147 (HERRING) shows a similar arrangement except for a different weave pattern. All the Herring US patents derive from the same group of provisional applications, and have similar disclosures.

U.S. Pat. No. 5,913,339 (LEE) features the provision of a pair of oppositely woven filler CD yarns between the last standard warp yarn and the pintle, where each filler yarn is interlaced with alternate upper and lower MD loop yarns.

U.S. Pat. No. 6,349,749 (QUIGLEY) features a weave pattern for the additional yarns similar to U.S. Pat. No. 6,289,940 (HERRING) mentioned above, but with one yarn woven preferentially with the top MD yarn layer and the other with the lower MD yarn layer.

In the above disclosures, it is to be noted that the additional cross machine direction yarns are inserted into the seam zone, after the last standard warp yarn, so that these yarns are the yarns which lie narest to the seam.

It has been found that such additional filler yarns tend to encroach into the seaming loops, as there is a tendency for them, due to low warp tension, to move laterally and become displaced towards the seaming zone, in turn causing an obstruction to pintle insertion and so making seaming increasingly more difficult. In addition, it has been found that seam loop distortion has also become an issue because of the fact that the additional binder yarns are woven in directly next to the seam loop.

SUMMARY OF THE INVENTION

An object of the invention is to provide a seamed felt wherein such encroachment is limited or obviated so that seaming is not substantially impeded by the migration of filler yarns into the seaming zone and also that loop distortion is avoided.

According to the invention there is provided a base fabric in a papermachine felt comprising weft yarns extending the machine direction and forming seaming loops at each end of the base fabric, cross-machine direction warp yarns being interwoven with the weft yarns, characterised in that a multi-filament yarn is inserted so that there is at least one standard warp yarn between the multi-filament yarn and the seaming loops on each side of the seam.

The standard warp yarns are preferably monofilament yarn.

More than one such multi-filament yarn may be inserted, for example two yarns.

The weave pattern of the said multi-filament yarn or yarns may be the same as the main body of the warp weave, but could if required be different.

An embodiment of the seamed felt according to the invention will now be further described by way of example with reference to the accompanying drawings, wherein.

DESCRIPTION OF PREFERRED EMBODIMENTS

A seamed felt according to the invention comprises a fibrous batt needled to a support fabric woven from synthetic yarns. The fabric is of a kind which has been woven endless, such that the yarns of the weft in the loom lie in the machine direction of the fabric on the paper machine and form the seam loops.

Figure 1:
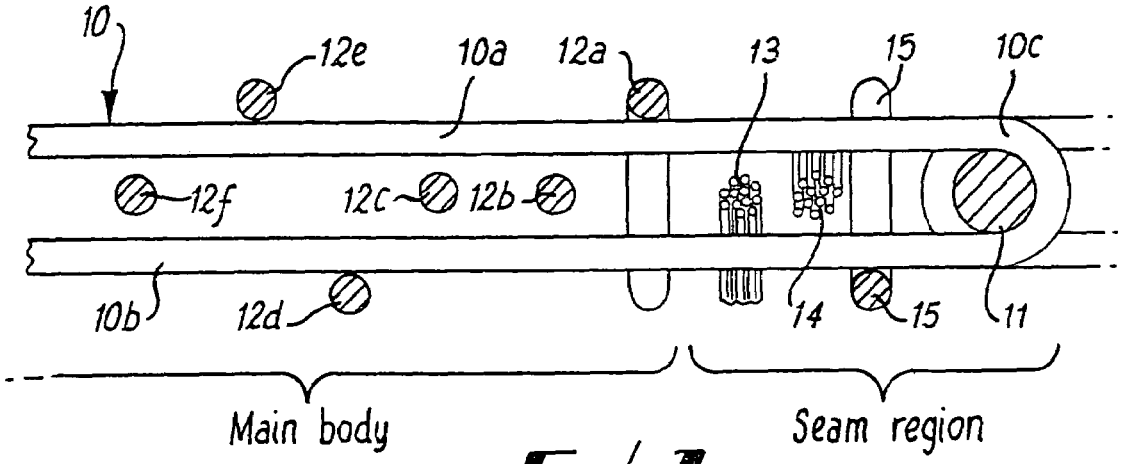
FIG. 1 is a diagrammatic longitudinal section of an end region of a fabric forming part of a seamed felt, in accordance with the invention, on line I—I of FIG. 2.

In the end region shown in FIG. 1, the weft yarn 10 shown has an upper pass 10*a* and a lower pass 10*b* forming a two layer weft structure, connected by a seaming loop 10*c*. The seaming loop 10*c* is intermeshed with corresponding seaming loops on the other end of the fabric, and joined by a pintle or jointing yarn 11.

Figure 2:
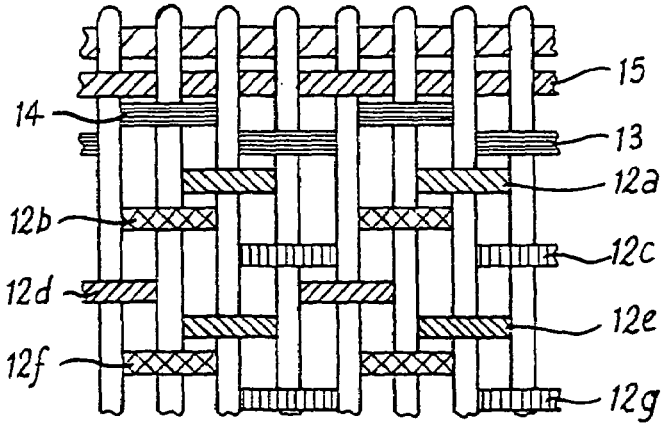
FIG. 2 is a diagrammatic top view of a small portion of the fabric end region.
Figure 3:
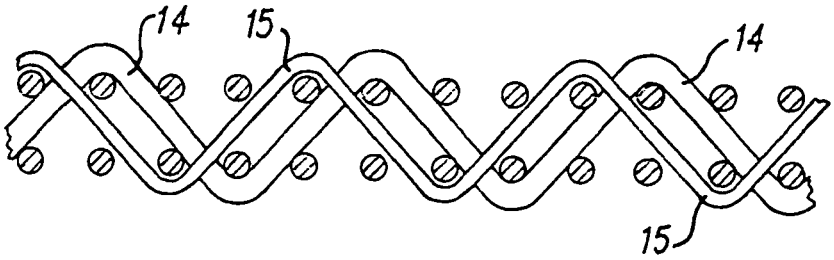
FIG. 3 shows the yarn paths diagrammatically as seen from the fabric end of the first two yarns from the fabric end.
Figure 4:
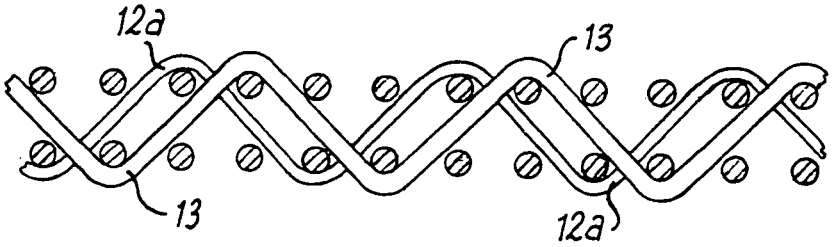
FIG. 4 is a view similar to the FIG. 3 showing the yarns paths of the third and fourth yarns from the fabric end.

The main body of the fabric is formed by interweaving a multiplicity of monofilament warp yarns 12 with the weft yarns 10 in for example an "under three and over one" (3 and 1) double layer weave pattern, with the weave knuckles above the upper weft 10*a* and below the lower weft 10*b* of successive warp yarns being displaced consistently by one or more weft yarns with respect to the proceeding warp yarn. Warp yarns 12*a*–12*e* are shown in order of distance from the seam in FIGS. 1 and 2.

12*a* is the last normal monofilament warp yarn of the main body of the fabric. The next yarn shown, in the seam region, comprises a first multi-filament filler yarn 13, which is woven into the next warp yarn path, in the same way as a normal monofilament yarn 12. A second multi-filament filler yarn 14 is woven into the fabric in the seam region next to the first multi-filament filler yarn 13, but this is displaced by two weft yarns with respect to filler yarns 13 so that its knuckles lie half way between the knuckles of the yarn 13. Finally the weave is completed by a further monofilament yarn 15 between the multi-filament yarn 14 and the loop.

The knuckles of this yarn 15 are displaced with respect to those of multi-filament yarn 14 by one weft yarn backwards with respect to the displacement of yarn 14 relative to yarn 13.

The multi-filament yarns 13, 14 are woven with lower tension than the standard warp yarns 12. It has been found that when using low warp tension of the filler yarns that these yarns undulate about the standard woven warp yarns 12 which are under normal higher tension. The multi-filament yarns at lower tension can move more freely and thus are able to move laterally over the adjacent standard warp yarn 15 towards the seam loop 12*c*, almost to the edge of the yarn 15.

This gives benefits in that the last yarn 15 serves to keep the yarns 13, 14 from spreading too far towards the loops as would occur if the binder yarns were located directly adjacent the seam loops.

Interference with the seam loop, and difficulties with seaming due to such encroachment are avoided as pintle space is not taken up by the added yarns.

The multi-filament yarns are however still close to the seam loop and are thus effective at aiding keying in of the batt fibres by needling. Moreover, distortion of the loops is avoided as the filler yarns are not woven directly next to the loops but are fenced by the yarn 15.

Alternatively, additional filler yarns such as 13, 14 can be woven in a plain weave using only one layer of MD yarns, or two layers of filler yarns can be woven with a plain weave in each of the yarn layers.

The filler yarns may be added by removal of and replacement of prewoven existing monofilament warp yarns. More than two filler yarns may be provided in the seam region.

It is of course to be understood that the invention is not intended to be restricted to the details of the above embodiments which are described by way of example only.

The invention claimed is:

1. Paper making machine fabric comprising weft yarns extending in the machine direction (MD) and forming seaming loops at each end of the fabric, cross machine direction (CD) warp yarns, all being interwoven with the weft yarns, characterized in that at least one multifilament warp yarn is inserted so that there is at least one standard warp yarn between the multifilament yarn and the seaming loops on each side of the seam.

2. Paper making machine fabric according to claim 1, characterized in that the at at least one multifilament yarn interweaves with at least some of the weft yarns extending in the machine direction (MD).

3. Paper making machine fabric according to claim 1, characterized in that the at least one multifilament interweaves with only one layer of weft yarns extending in the machine direction (MD).

4. Paper making machine fabric according to claim 1, characterized in that the at least one multifilament interweaves with more than one layer of weft yarns extending in the machine direction (MD).

5. Paper making machine fabric according to claim 1, characterized in that the standard yarns are monofilament yarns.

6. Paper making machine fabric according to claim 1, characterized in that two or more multifilament yarns are inserted.

7. Paper making machine fabric according to claim 1, characterized in that the at least one multifilament yarn is continuing the weave pattern formed by the interweaving of the standard warp yarns and the weft yarns.

8. Paper making machine fabric according to claim 1, characterized in that the at least one multifilament yarn is woven with lower tension than the standard warp yarns.

9. Paper making machine fabric according to claim 1, characterized in that the fabric is a base fabric of a press felt.

10. Paper making machine fabric according to claim 2, characterized in that the standard yarns are monofilament yarns.

11. Paper making machine fabric according to claim 2, characterized in that two or more multifilament yarns are inserted.

12. Paper making machine fabric according to claim 2, characterized in that the at least one multifilament yarn is continuing/is not continuing the weave pattern formed by the interweaving of the standard warp yarns and the weft yarns.

13. Paper making machine fabric according to claim 2, characterized in that the at least one multifilament yarn is woven with lower tension than the standard warp yarns.

14. Paper making machine fabric according to claim 2, characterized in that the fabric is a base fabric of a press felt.

15. Paper making machine fabric according to claim 2, characterized in that the at least one multifilament interweaves with only one layer of weft yarns extending in the machine direction (MD).

16. Paper making machine fabric according to claim 2, characterized in that the at least one multifilament interweaves with more than one layer of weft yarns extending in the machine direction (MD).

17. Paper making machine fabric according to claim 2, characterized in that the standard yarns are monofilament yarns.

18. Paper making machine fabric according to claim 17, characterized in that two or more multifilament yarns are inserted.

19. Paper making machine fabric according to claim 17, characterized in that the at least one multifilament yarn is continuing the weave pattern formed by the interweaving of the standard warp yarns and the weft yarns.

20. Paper making machine fabric according to claim 17, characterized in that the at least one multifilament yarn is woven with lower tension than the standard warp yarns.

21. Paper making machine fabric according to claim 17, characterized in that the fabric is a base fabric of a press felt.

22. Paper making machine fabric according to claim 1, characterized in that the at least one multifilament yarn is Dot continuing the weave pattern formed by the interweaving of the standard warp yarns and the weave yarns.

* * * * *